US006137384A

United States Patent [19]

Kubota et al.

[11] Patent Number: 6,137,384

[45] Date of Patent: Oct. 24, 2000

[54] DIELECTRIC RESONATOR DIELECTRIC FILTER DIELECTRIC DUPLEXER AND COMMUNICATION DEVICE

[75] Inventors: Kazuhiko Kubota, Mukou; Tomoyuki Ise, Nagaokakyo, both of Japan

[73] Assignee: Murata Manufacturing Co., Ltd., Japan

[21] Appl. No.: 09/253,802

[22] Filed: Feb. 19, 1999

[30] Foreign Application Priority Data

Feb. 20, 1998 [JP] Japan ..... 10-038810

[51] Int. Cl.[7] ..... H01P 7/10; H01P 7/00; H01P 1/20

[52] U.S. Cl. ..... 333/219.1; 333/219; 333/202

[58] Field of Search ..... 333/202, 206, 333/208, 222, 219.1, 132, 135, 219

[56] References Cited

U.S. PATENT DOCUMENTS 4,142,164 2/1979 Nishikawa et al. ..... 333/219
4,484,162 11/1984 Kamada et al. ..... 333/202
4,864,259 9/1989 Takamoro et al. ..... 333/189
5,162,761 11/1992 Kita et al. ..... 333/219
5,987,341 11/1999 Hodge et al. ..... 333/219

*Primary Examiner*—Robert Pascal
*Assistant Examiner*—Patricia T. Nguyen
*Attorney, Agent, or Firm*—Ostrolenk, Faber, Gerb & Soffen, LLP

[57] ABSTRACT

A dielectric filter has an electroconductive case, dielectric resonators each having electrodes formed on the opposite sides thereof disposed inside of the case, a ground plate disposed inside of the case, and external connectors. At least one of the electrodes is a thin film multilayered electrode connected to the ground plate. The ground plate is provided with protuberant portions, and each of the protuberant portions is connected, at the lower surface portion of the protuberant portion, to the respective thin film multilayered electrode on a corresponding dielectric resonator. The lower surface of the protuberant portion is smaller than the size of the corresponding dielectric resonator defined by the side edges thereof.

14 Claims, 9 Drawing Sheets

DIELECTRIC RESONATOR DIELECTRIC FILTER DIELECTRIC DUPLEXER AND COMMUNICATION DEVICE

BACKGROUND OF THE INVENTION

1. Field of the Invention

The present invention relates to a dielectric resonator, and more particularly, to a dielectric resonator having a thin film multi-layered electrode and a dielectric filter and duplexer including the dielectric resonator which are applicable to communication apparatuses and the like for use in base stations of a cellular telephone system, and a communication device including the dielectric filter.

2. Description of the Related Art

FIG. 9 is an exploded perspective view of a dielectric filter which is related to the present invention. The dielectric filter is described in the co-pending U.S. patent application Ser. No. 08/924,040 filed Aug. 29, 1997, now U.S. Pat. No. 6,052,041, the disclosures of which are incorporated by reference. However, the art disclosed in the '040 application was not publicly known on the filing date of Japanese Patent Application No. H10-38810, the priority application on which the present invention is based. In FIG. 9, a dielectric filter 110 comprises a metallic case 111, dielectric resonators 112 disposed inside of the case 111, a ground plate 113, coupling probes 114, and external connectors 115 attached to the outside wall of the case and connected to the probes 114, respectively. The case 111 comprises a trunk 111*a* and an upper lid 111*b*. On the upper and under sides of each dielectric resonator 112, thin film multilayered electrodes are formed, respectively. Each thin film multilayered electrode is composed of dielectric layers and conductor layers alternately laminated to each other. The detailed structure of the thin film multilayered electrode is described in the co-pending U.S. patent application Ser. No. 08/604,952 filed Feb. 27, 1996, now pending (international application number PCT/JP94/00357). The disclosures of the '952 and '357 applications are incorporated herein by reference.

The ground plate 113 is made of a metallic plate. For the purpose of reducing the temperature dependency of the filter characteristics, the ground plate has a coefficient of linear expansion equal to that of the dielectric resonators 112. The dielectric resonators 112 are fixed to the ground plate 113 by soldering. The ground plate 113 is sandwiched between the trunk 111*a* and the lid 111*b*, and thereby, the dielectric resonators 112 are disposed in the case 111. The ground plate 113 is placed on the trunk 111*a* so that gaps are formed between the dielectric resonators 112 and the trunk 111*a*.

Each coupling probe 114 is made of a metallic wire and extends into the gap between a corresponding dielectric resonator 112 and the trunk 111*a*. The coupling probe 114 and the dielectric resonator 112 are capacitively coupled. The two dielectric resonators together function as a dielectric filter. If the external connectors 115 are connected through a $\lambda/4$ line 117, the dielectric filter functions as a band elimination dielectric filter.

In order to fix the dielectric resonators to the ground plate, soldering techniques are generally used as described above. For the purpose of making the best use of the characteristics of the thin film multilayered electrodes, it is preferable to consider the following points. FIG. 10 is a cross-sectional view taken along a line W—W of FIG. 9. Solder is coated onto the upper side of the dielectric resonator 112 with a soldering iron and retained there so as to short-circuit the under side of the ground plate and the resonator. As a result, the respective electrodes of the thin film multilayered electrode are short-circuited. The solder may be permeated between the resonator 12 and the ground plate 113 according to re-flow techniques. However, excess solder reaches the side of the resonator to short-circuit the respective electrodes of the thin film multilayered electrode.

The thin film multilayered electrode is provided for the purpose of enhancing the non-loaded Q of the dielectric filter, by reduction of the conductor loss in the electrode due to the skin effect. The thicknesses of the respective electrode layers are strictly set. Therefore, the short-circuiting of the respective electrode layers as described above should be avoided.

In the event that a stress, caused by external vibration or impact, is applied to the ground plate, the stress is transmitted to one or more side edges of the thin film multilayered electrode, since the ground plate is flat. The thin film multilayered electrode is susceptible to being peeled apart at its side edges. Thus, there is a possibility that the thin film multilayered electrode may be peeled apart, or peeled off of the ground plate, at a side edge thereof.

SUMMARY OF THE INVENTION

The present invention is able to solve the above-described technical problems and to provide a dielectric filter formed of dielectric resonators, a dielectric duplexer, and a communication device which have a high non-loaded Q and excellent reliability.

Such a dielectric filter may advantageously comprise a case having cavities, the inner sides of the cavities being coated with a metallic film; a ground plate, which may be a metallic ground plate or a ground plate coated with a metal, covering the openings of the cavities to form shielded cavities; and dielectric resonators fixed to the ground plate and accommodated in the cavities, respectively. Electrode layers are formed respectively on the side of each dielectric resonator adjacent to the ground plate and on the side opposite thereto. At least the electrode layer adjacent to the ground plate is preferably a thin film multilayered electrode.

The ground plate has a protuberant portion which projects toward the inner sides of the cavities so as to contact the thin film electrodes. The dielectric resonators are placed on the formed protuberant portions. The area of each protuberant portion of the ground plate is smaller than that of the side of the dielectric resonator adjacent to the protuberant portion. Therefore, when the dielectric resonator is soldered to the protuberant portion, the solder is prevented from reaching the side edge of the thin film multilayered electrode.

The protuberant portion may be provided with a hole which is smaller than and lies within the area of the protuberant portion defined by the side edge thereof.

The hole may further be provided with a cut or recessed portion on the periphery thereof.

According to another aspect of the invention, a dielectric resonator may comprise a dielectric block having at least one surface; an electrode disposed on said surface; a metal casing surrounding said dielectric block; a supporting portion protruding from one side of said metal casing toward the inside of said metal casing; a conductive layer connecting said surface of the dielectric block with said supporting portion, edges of said conductive layer being spaced inwardly from edges of said one surface of said dielectric block; and an accessing element being disposed through an wall of said metal casing, said accessing element being electromagnetically coupled with said dielectric block.

Other features and advantages will be appreciated from the following detailed description of embodiments of the invention, in which like references correspond to like elements and parts, taken together with the drawings.

DESCRIPTION OF EMBODIMENTS OF THE INVENTION

Figure 11:
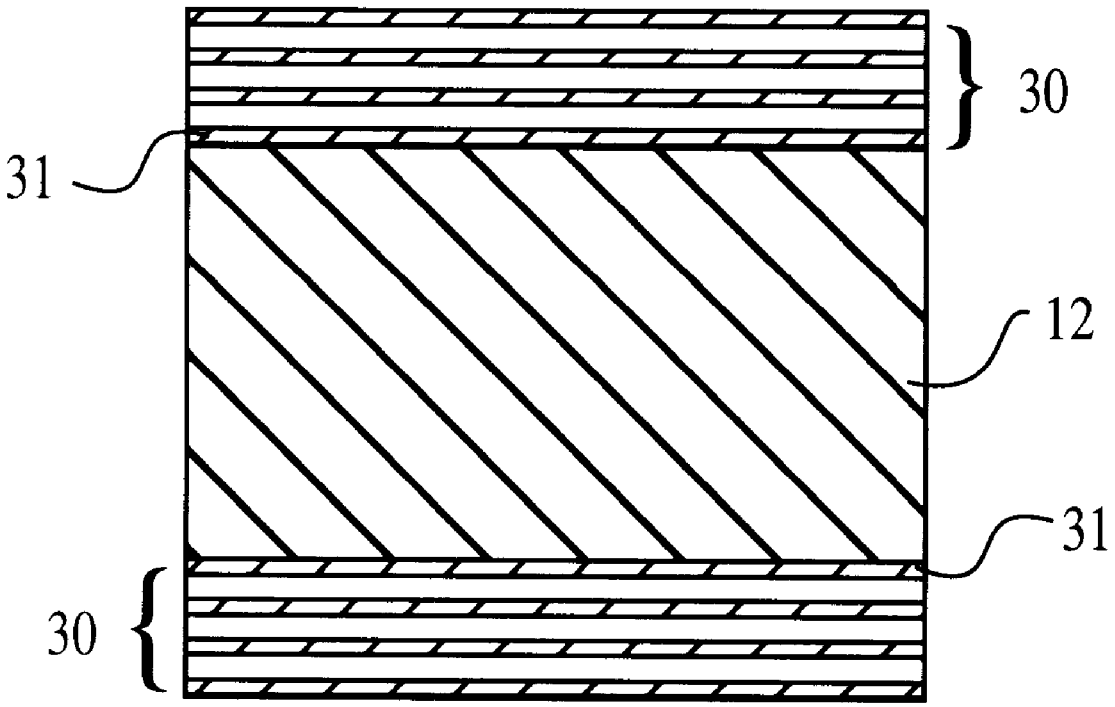
FIG. 11 is a cross-sectional view of a dielectric resonator for use in all three of the disclosed embodiments of the invention.

A dielectric filter according to a first embodiment of the present invention will be described below with reference to FIGS. 1 and 2. FIG. 11 is a cross-sectional view of a dielectric resonator for use in all three of the disclosed embodiments of the invention, including the present embodiment.

Hereinafter, a two-stage band elimination filter will be described, comprising two dielectric resonators and input-output probes adapted to be electromagnetically coupled to the resonators, respectively, in which the probes are connected to each other through a $\lambda/4$ line. However, the present invention is not limited only to the above-described type of filter and may be applied to another type of resonator, filter and duplexer. The filters and duplexers which will be shown below comprise respective resonators. Thus, it will be clearly understood that the present invention can also be applied to a single resonator.

Figure 1:
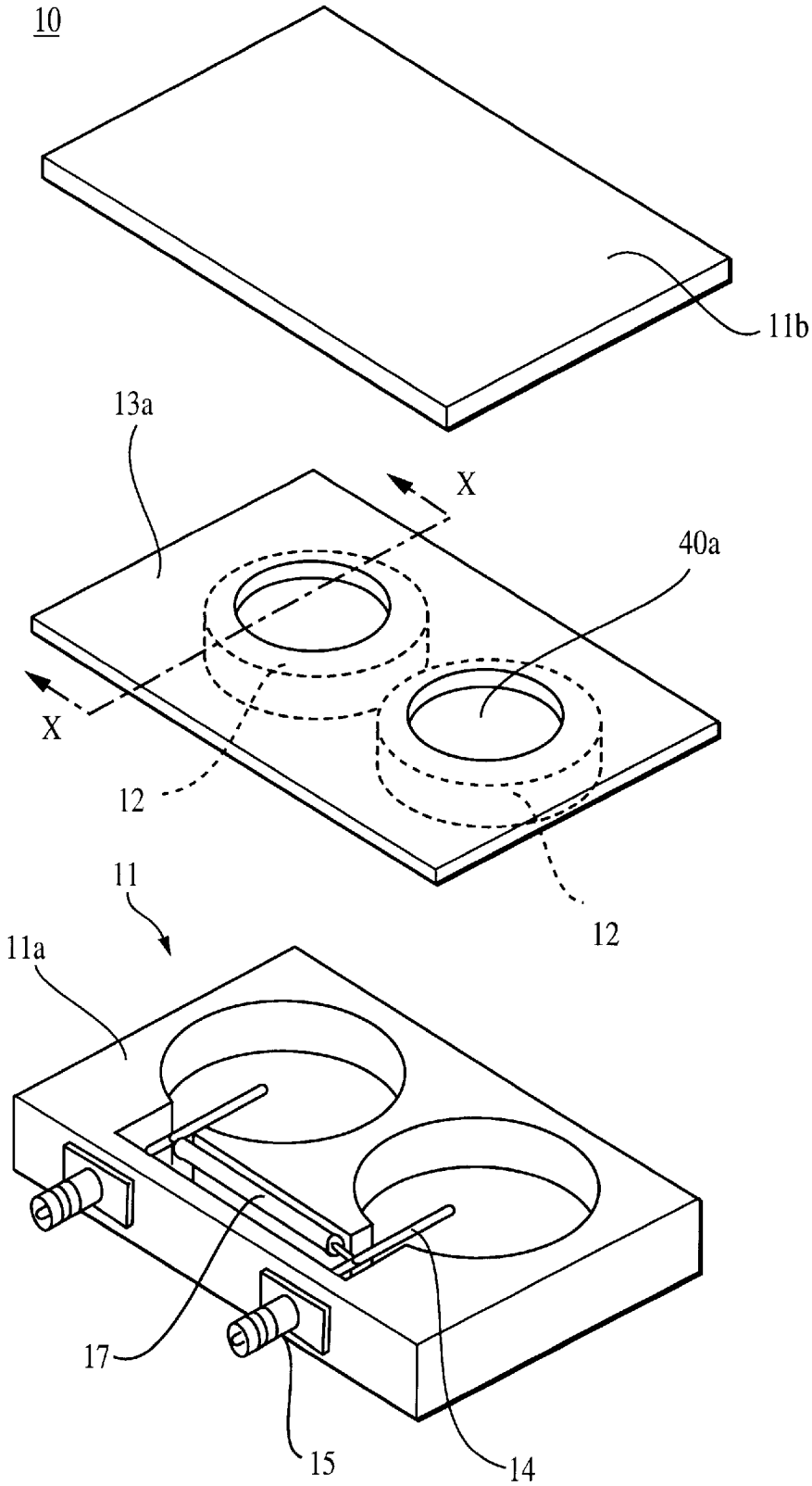
FIG. 1 is an exploded perspective view of a dielectric filter according to a first embodiment of the present invention.

As shown in FIG. 1, a dielectric filter 10 comprises a case 11 made of an iron body plated with silver for example, dielectric resonators 12, a ground plate 13*a*, coupling probes 14, and external connectors 15 attached to the outer wall of the case 11 and connected to the probes 14, respectively.

Thin film multilayered electrodes 30 each composed of conductive layers and dielectric layers laminated to each other and formed by sputtering or the like are provided on the two opposite sides of each dielectric resonator 12, respectively. The ground plate 13*a* is preferably made of an alloy of iron and nickel, so that the coefficient of linear expansion of the dielectric resonators 12 can be made substantially equal to that of the ground plate 13*a*. This prevents cracks from forming between the dielectric resonators 12 and the ground plate 13*a*, due to changes in temperature. Each coupling probe 14 is a metallic wire. One end of each probe 14 is connected to the center conductor of the corresponding external connector 15. The probe 14 is elongated and extends in the space between the dielectric resonator 12 and the case 11. A signal transmitted from the external connector 15 arrives at the probe 14. The probe 14 and the dielectric resonator 12 are capacitively coupled.

The dielectric resonator 12 may have a prism shape.

The case 11 may be a ceramic case provided with a metallic conductive layer formed thereon.

Hereinafter, the process of joining the dielectric resonator 12 to the ground plate 13 will be described with reference to FIG. 2.

Figure 2:
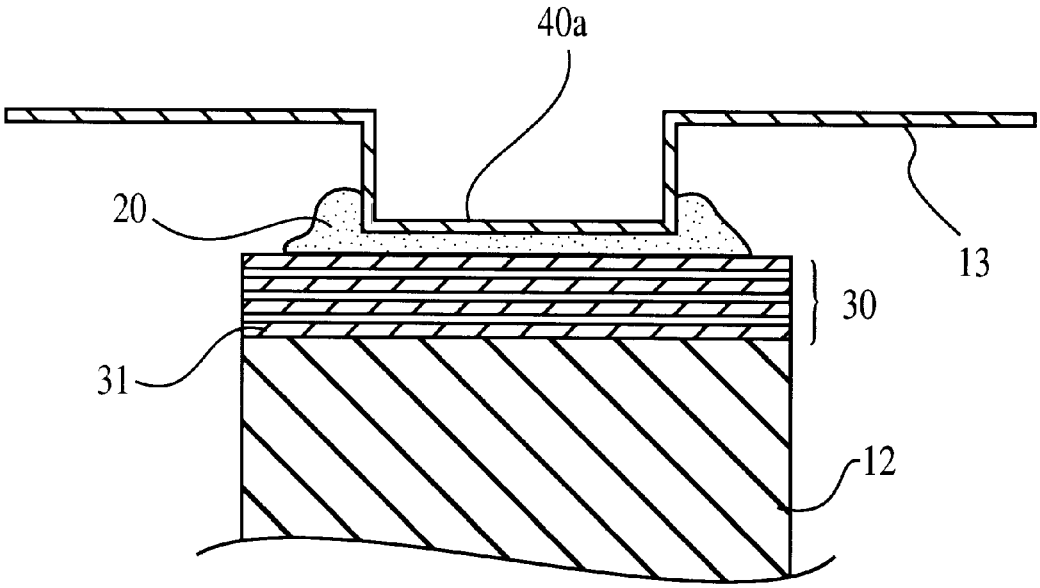
FIG. 2 is a cross-sectional view taken along line X—X of FIG. 1.

The ground plate 13*a* is provided with a protuberant portion 40*a* having an under side with a smaller area than the upper side of the dielectric resonator 12, formed by press working or the like, as shown in FIG. 2. Preferably, the under side of the protuberant portion is substantially flat. A creamy solder 20 is adhered mainly to the under side of the protuberant portion 40*a* of the ground plate 13*a*, as shown in FIG. 2. The dielectric resonator 12 is fixed to the protuberant portion 40*a* by placing the upper side of the resonator 12 adjacent to the protuberant portion 40*a*, and heating the solder. During this process, preferably, the side edge of the thin film multilayered electrode 30 formed in the dielectric resonator 12 is kept away from underneath the side edge of the protuberant portion 40*a* of the ground plate 13*a*. This is to prevent the solder coated onto the under side of the protuberant portion from reaching the side edge of the thin film multilayered electrode. In other words, it is preferable for the protuberant portion to be as distant as possible from any point on the side edge on the upper side of the dielectric resonator, i.e., the side edge of the electrode.

In such a manner, a space is provided between the side edge of the thin film multilayered electrode 30 and the ground plate 13*a*. When the solder 20 is permeated between the thin film multilayered electrode 30 and the ground plate 13*a*, the area just outside the protuberant portion 40*a* functions as a buffer or reservoir for the solder 20. Thus, the solder 20 is prevented from reaching the side edge of the thin film multilayered electrode 30.

The protuberant portion may have any effective shape. Desirably, the height of the protuberant portion is constant so that a solder film uniform in thickness can be formed between the resonator and the protuberant portion.

The protuberant portion 40*a* of the ground plate 13*a* is joined to the thin film multilayered electrode 30 at its lower surface portion which is smaller than the area of the upper side of the thin film multilayered electrode 30 defined between the side edges thereof. Accordingly, even if a stress, caused by vibration or impact, is applied to the ground plate 13*a*, the area where the force will exert its main influence lies within the side edges of the thin film multilayered electrode 30. Therefore, only a very weak stress will be applied to the side edges of the thin film multilayered electrode 30. Thus, there is no possibility that the thin film multilayered electrode 30 will be peeled apart due to an external vibration or impact.

The ground plate 13*a* soldered to the dielectric resonator 12 is sandwiched between the trunk 11*a* and the lid 11*b* of the case 11, namely, it is disposed inside of the case 11.

Figure 3:
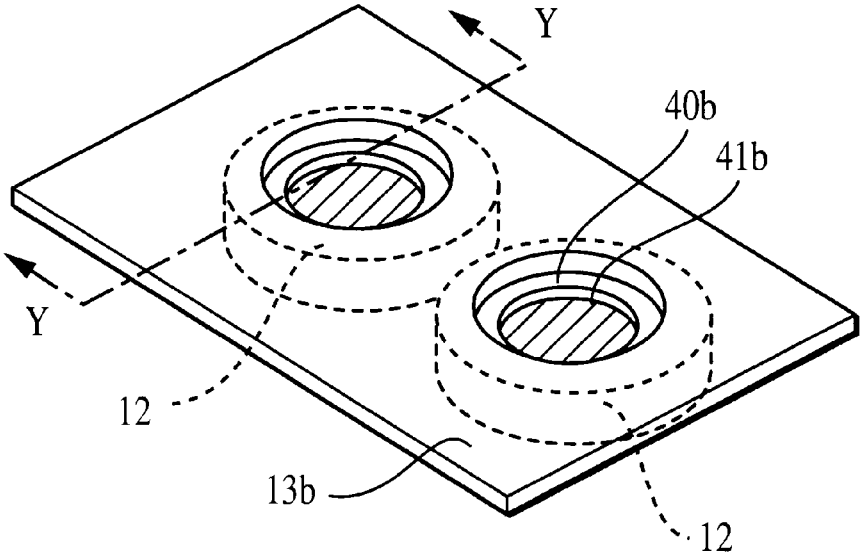
FIG. 3 is a perspective view of a dielectric resonator and a ground plate portion according to a second embodiment of the present invention.
Figure 4:
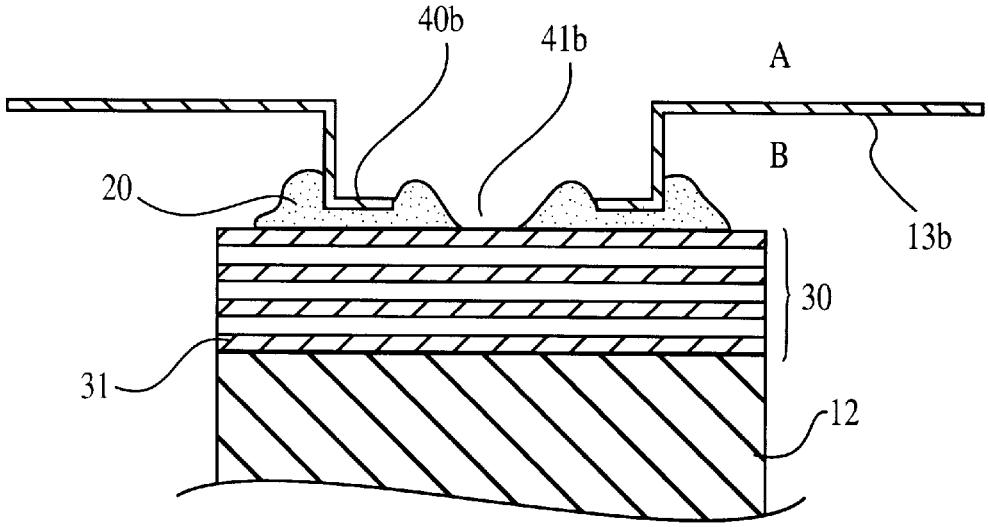
FIG. 4 is a cross-sectional view taken along line Y—Y of FIG. 3.

According to a second embodiment of the present invention, an aperture is provided for a part of the protuberant portion of the ground plate. The configuration in the instant embodiment is the same as that of the first embodiment except for the aperture. FIG. 3 is a perspective view of the dielectric resonator and the ground plate. FIG. 4 is a cross-sectional view taken along line Y—Y of FIG. 3.

In the instant embodiment, a circular hole 41*b* is provided in the protuberant portion 40*b* by punching or the like, having a size smaller than the size of the protuberant portion 40*b* defined by the side edge thereof.

Hereinafter, a process of soldering the dielectric resonator 12 provided with the thin film multilayered electrode 30 thereon to the ground plate 13*b* formed as described above will be described. The dielectric resonators 12 and the protuberant portion 40*b* are arranged in their preferred positions relative to each other as described above. Solder is cast between the dielectric resonator 12 and the protuberant portion 40*b* by inserting a soldering iron from the side A shown in FIG. 4 through the hole 41*b* and contacting the upper side of the thin film multilayered electrode 30. The amount of the cast solder is sufficient to extend between the protuberant portion 40*b* and the upper side of the resonator. Preferably, there is enough solder that the surface of the liquid solder reaches the side wall of the protuberant portion 40*b*, and forms a smooth curved surface. When such an amount of solder is cast, it does not reach the side edge of the thin film multilayered electrode.

Accordingly, the lower surface portion of the protuberant portion 40*b* of the ground plate 13*b* is joined to the thin film multilayered electrode 30, the lower surface portion being smaller in area than the upper side of the thin film multilayered electrode 30 defined by its side edges. Accordingly, even if a stress, caused by vibration or impact, is applied to the ground plate 13*a*, the range where the force exerts its main influence lies within the side edges of the thin film multilayered electrode 30. Therefore, there is little stress applied to the side edges of the thin film multilayered electrode 30. Thus, there is no possibility of peeling off part of the thin film multilayered electrode 30 due to an external vibration or impact.

With the hole 41*b* provided for the ground plate 13*b*, soldering can be carried out by operating a solder iron or the like from the side A of the ground plate 13*b*. Accordingly, the work is simplified.

Figure 5:
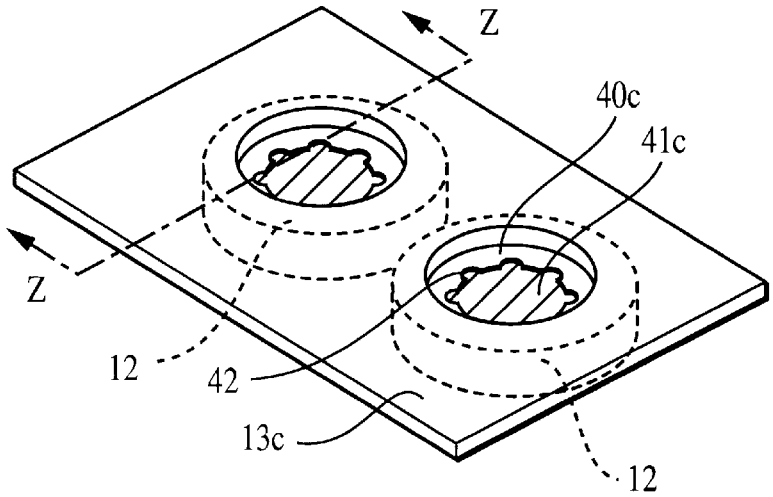
FIG. 5 is a perspective view of a dielectric resonator and a ground plate portion according to a third embodiment of the present invention.
Figure 6:
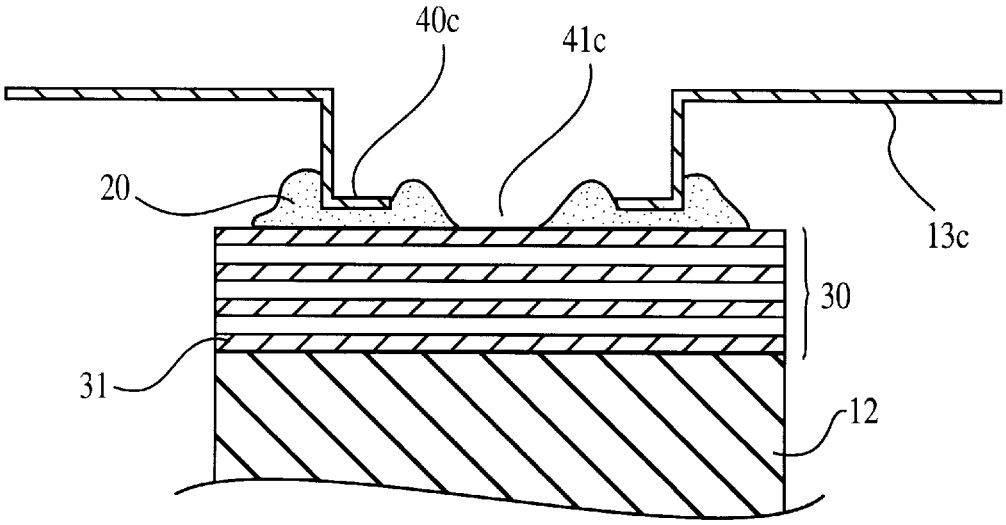
FIG. 6 is a cross-sectional view taken along line Z—Z of FIG. 5.

A third embodiment of the present invention will be now described. The arrangement and function of the dielectric filter in the instant embodiment are the same as those in the second embodiment. Therefore, their description will be omitted. Only the process of joining the dielectric resonator to the ground plate will be explained, with reference to FIGS. 5 and 6. FIG. 5 is a perspective view of the dielectric resonator and the ground plate. FIG. 6 is a cross-sectional view taken along line Z—Z of FIG. 5.

In the instant embodiment, the columnar thin film multilayered electrodes 30 are formed by sputtering on the opposite sides of the dielectric resonator 12. A protuberant portion 40*c* is formed in a ground plate 13*c* by press working. The ground plate 13*c* is made of an alloy of iron and nickel. The protuberant portion 40*c* has an under side whose area is smaller than the upper side of the dielectric resonator 12 which is in opposition to the protuberant portion. Preferably, the under side is substantially flat. In the under side of the protuberant portion 40*c*, an aperture 41*c* is formed by punching.

At least one bay-shaped or recessed portion 42 is provided in the periphery of the aperture. The recessed portion 42 may have any optional shape and size on the condition that the area where the solder and the aperture contact each other is thereby increased.

As described above, the aperture 41*c* of the ground plate 13*c*, having at least one recessed portion 42, has a circumferential length, where the soldering is carried out, longer than that of an aperture of equal size but having no such recessed portion 42. Accordingly, the recessed portion 42 improves the joining by soldering of the dielectric resonator and the protuberant portion.

Figure 7:
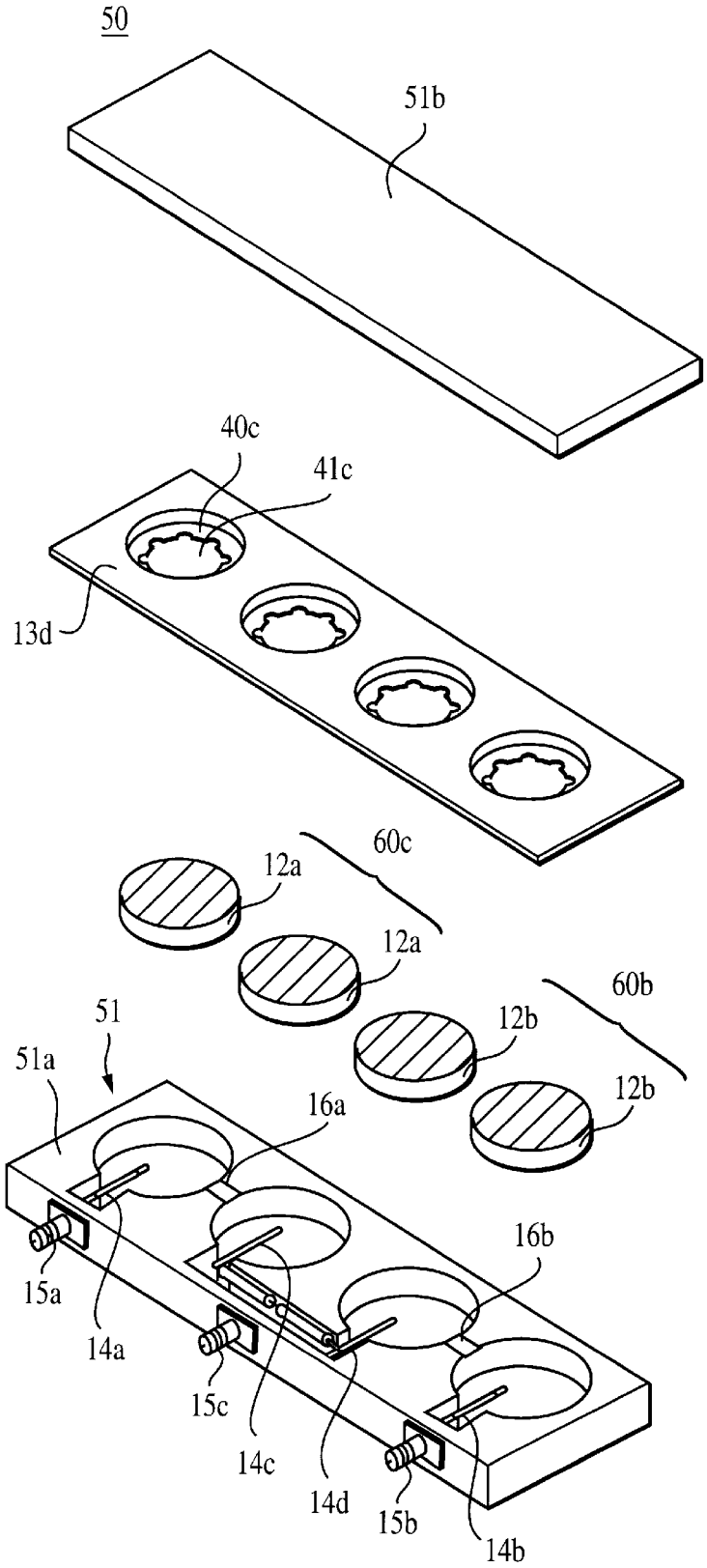
FIG. 7 is an exploded perspective view of a dielectric duplexer according to the present invention.

A dielectric duplexer according to an embodiment of the present invention will be described below with reference to FIG. 7. FIG. 7 is an exploded perspective view of the dielectric duplexer of this embodiment. In this embodiment, like parts to those in the first embodiment are designated by like reference numerals, and the detailed description of the parts will be omitted.

As shown in FIG. 7, a dielectric duplexer 50 of this embodiment includes a first dielectric filter portion 60*a* made up of two columnar dielectric resonators 12*a*, and a second dielectric filter portion 60*b* made up of two columnar dielectric resonators 12*b*, which are disposed in a case 5. On both opposite sides of the respective dielectric resonators 12*a* and 12*b* are formed thin film multilayered electrodes each composed of conductive layers and dielectric layers laminated together.

The two dielectric resonators 12*a* constituting the first dielectric filter portion 60*a* are coupled through a capacitance produced by a coupling member 16*a* and function as a transmitting band pass filter. The two dielectric resonators 12*b* constituting the second dielectric filter portion 60*a* and having a resonant frequency different from that of the dielectric resonators 12*a* of the first dielectric filter 60*a* are also coupled together through a capacitance produced by a coupling member 16*b*, and function as a receiving band pass filter. An electric probe 14*a* for providing an external connection is coupled to a dielectric resonator 12*a* of the first dielectric filter portion 60*a* and to an external connector 15*a* for being connected to an external transmitting circuit. An electric probe 14*b* is coupled to a dielectric resonator 12*b* of the second dielectric filter portion 60*b* and to an external connector 15*b*, for being connected to an external receiving circuit. Further, an electric probe 14*c* coupled to the other dielectric resonator 12*a* of the first dielectric filter portion 60*a* and an electric probe 14*d* coupled to the other dielectric resonator 12*b* of the second dielectric filter portion 60*b* are connected to an external connector 15*c*, for being connected to an external antenna.

The dielectric duplexer having the above-described configuration functions as a band pass dielectric filter. That is, the first dielectric filter portion 60*a* allows a wave with a predetermined frequency to pass, and the second dielectric filter portion 60*b* allows a wave with a different frequency from that of the above wave to pass.

In the instant embodiment, the dielectric resonators 12*a* and 12*b* are soldered to the ground plate 13*d* and sandwiched between the trunk 51*a* of a shielding cavity 51 and a lid 51*b* to be disposed inside of the case 51. The ground plate 13*d* has the protuberant portions 40*c* and the holes 41*c* for soldering. Each protuberant portion 40*c* has an under side with an area smaller than that of the upper side of the thin film multilayered electrode, defined by the side edges thereof. This prevents the solder from reaching the side edges of the thin film multilayered electrode. That is, the thin film multilayered electrode is prevented from being short-circuited. Thus, a dielectric duplexer having a high non-load Q can be provided. In addition, there is a reduced possibility of the thin film multilayered electrode being peeled apart by an external impact or the like.

Figure 8:
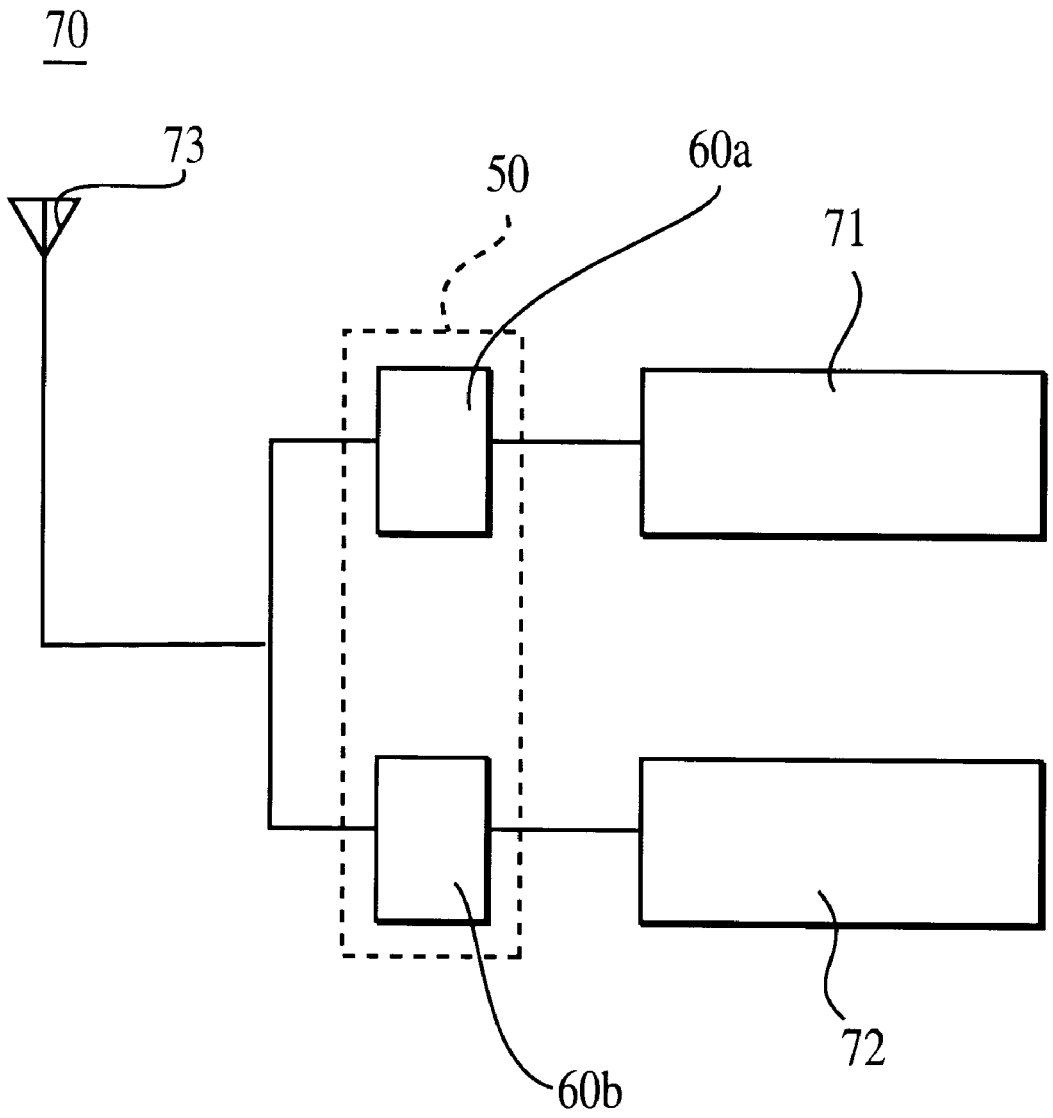
FIG. 8 is an exploded perspective view of a communication device according to the present invention.
Figure 9:
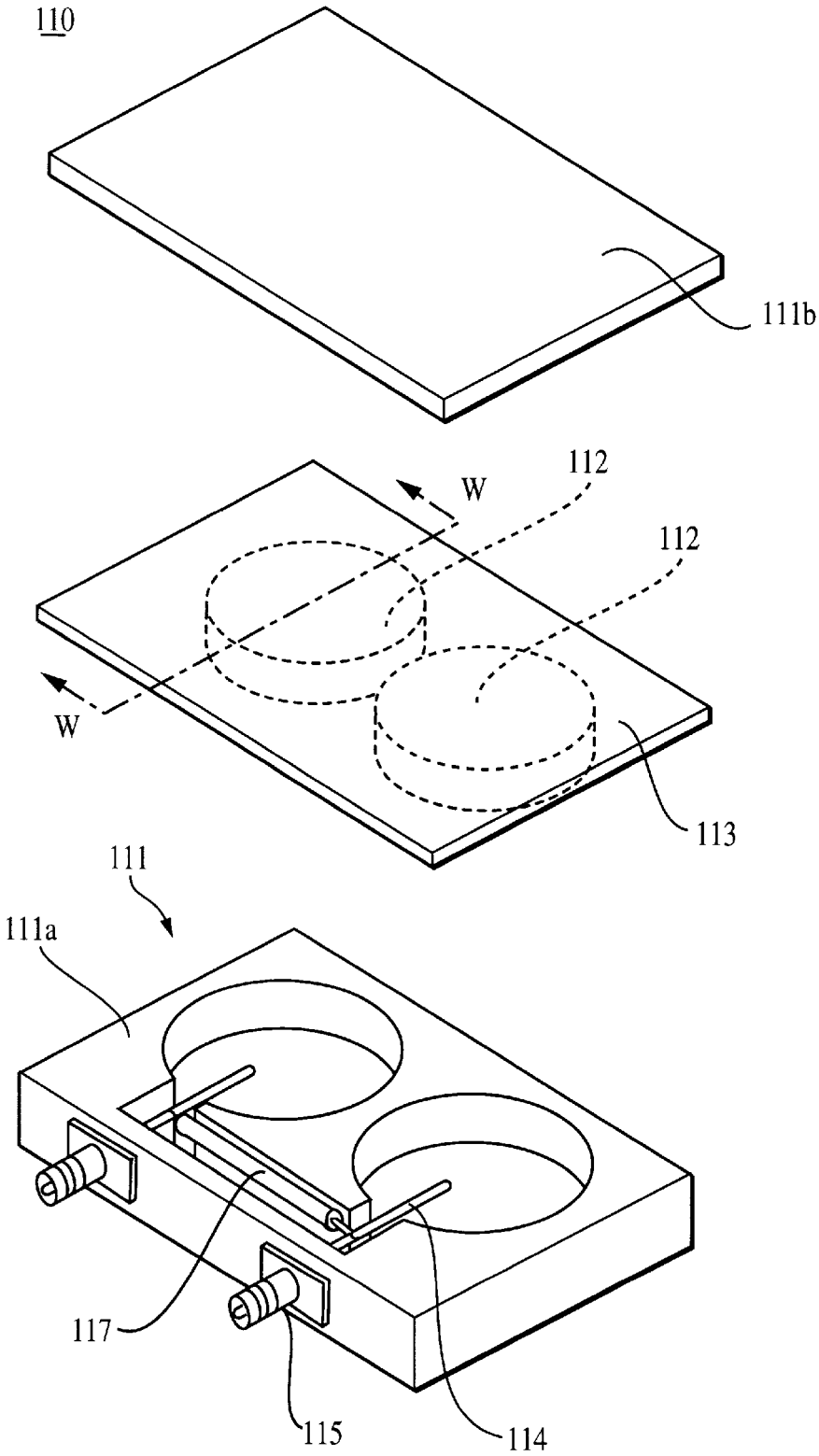
FIG. 9 is an exploded perspective view of an another type of dielectric filter.
Figure 10:
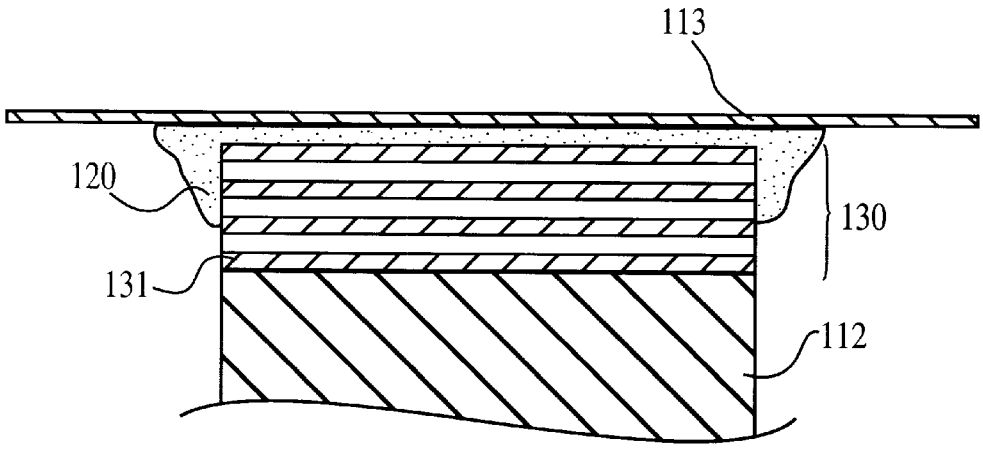
FIG. 10 is a cross-sectional view taken along line W—W of FIG. 9.

A communication device according to an embodiment of the present invention will be described below with respect to FIG. 8. FIG. 8 is a schematic diagram of a communication device of this embodiment.

As shown in FIG. 8, a communication device 70 of this embodiment comprises the dielectric duplexer 50 of the previous embodiment, a transmitting circuit 71, a receiving circuit 72, and an antenna circuit connected to an antenna 73. The external connector 15a connected to the first dielectric filter portion 60*a*, shown in FIG. 7, is connected to the transmitting circuit 71. The external connector 15*b* connected to the second dielectric filter portion 60*b* is connected to the receiving circuit 72. In addition, the external connector 15*c* is connected to an antenna 73.

In the instant embodiment, the dielectric resonators are soldered to the ground plate and sandwiched between the trunk of the case and its lid, that is, it is disposed inside of the case. For the ground plate, the protuberant portions and the holes for soldering are provided. Each of them has an under side with an area smaller than that of the upper side of the thin film multilayered electrode, defined by the side edges thereof. Accordingly, the solder is prevented from reaching the side edges of the thin film multilayered electrode. That is, the thin film multilayered electrode is prevented from being short-circuited. Thus, a communication device having a high non-load Q can be provided. In addition, there is a reduced possibility of the thin film multilayered electrode being damaged by an external impact or the like. Thus, a communication device having high reliability can be obtained.

Although embodiments of the invention have been disclosed herein, the invention is not limited to such embodiments. Rather, the invention includes all modifications and variations which may occur to those having the ordinary level of skill in the pertinent art.

What is claimed is:

1. A dielectric filter comprising:

a case having electroconductivity;

a dielectric resonator having two opposite sides, said dielectric resonator having electrodes provided on said opposite sides thereof and being disposed inside of said case;

a ground plate disposed inside of said case; and an external connector for connecting said dielectric resonator to an external circuit;

wherein said ground plate is provided with a protuberant portion, said protuberant portion having a surface portion which is connected to one side of said dielectric resonator by contacting one of said electrodes thereon, said surface portion of the protuberant portion being smaller than the area of said one electrode and spaced inwardly from side edges thereof.

2. A dielectric filter according to claim 1, further comprising a conductive adhesive material disposed for fixing said protuberant portion to said one electrode, said conductive adhesive material being spaced inwardly from said side edges of said one electrode.

3. A dielectric filter according to claim 1, wherein said one electrode on said dielectric resonator connected to said ground plate is a thin film multilayered electrode.

4. A dielectric filter according to claim 3, further comprising a conductive adhesive material disposed for fixing said protuberant portion to said one electrode, said conductive adhesive material being spaced inwardly from said side edges of said one electrode.

5. A dielectric filter according to claim 1, wherein said protuberant portion is provided with a hole, and said hole is smaller than and lies within the area of said protuberant portion defined by side edges thereof.

6. A dielectric filter according to claim 5, further comprising a conductive adhesive material disposed for fixing said protuberant portion to said one electrode, said conductive adhesive material being spaced inwardly from said side edges of said one electrode.

7. A dielectric filter according to claim 3, wherein said hole has a peripheral shape provided with a recessed portion for increasing the length of the peripheral shape.

8. A dielectric filter according to claim 7, further comprising a conductive adhesive material disposed for fixing said protuberant portion to said one electrode, said conductive adhesive material being spaced inwardly from said side edges of said one electrode.

9. A dielectric duplexer comprising:

two dielectric filters, a pair of input-output connectors for connecting a transmitting circuit and a receiving circuit to respective ones of the dielectric filters, and an antenna connector for connecting an antenna to both of said dielectric filters, wherein at least one of said dielectric filters comprises:

a case having electroconductivity;

a dielectric resonator having two opposite sides, said dielectric resonator having electrodes provided on said opposite sides thereof and being disposed inside of said case; and a ground plate disposed inside of said case;

wherein said ground plate is provided with a protuberant portion, said protuberant portion having a surface portion which is connected to one side of said dielectric resonator by contacting one of said electrodes thereon, said surface portion of the protuberant portion being smaller than the area of said one electrode and spaced inwardly from side edges thereof.

10. A dielectric duplexer according to claim 9, wherein said dielectric resonator is coupled to one of said input/output connectors.

11. A dielectric duplexer according to claim 9, wherein said dielectric resonator is coupled to said antenna connector.

12. A dielectric duplexer according to claim 9, wherein both of said dielectric filters are contained within said case.

13. A communication device comprising:

a dielectric duplexer comprising:

two dielectric filters, a pair of input-output connectors for connecting a transmitting circuit and a receiving circuit to respective ones of the dielectric filters, and an antenna connector for connecting an antenna to both of said dielectric filters, wherein at least one of said dielectric filters comprises:

a case having electroconductivity;

a dielectric resonator having two opposite sides, said dielectric resonator having electrodes provided on said opposite sides thereof and being disposed inside of said case; and a ground plate disposed inside of said case;

wherein said ground plate is provided with a protuberant portion, said protuberant portion having a surface portion which is connected to one side of said dielectric resonator by contacting one of said electrodes thereon, said surface portion of the protuberant portion being smaller than the area of said one electrode and spaced inwardly from side edges thereof;

wherein said communication device further comprises a transmitting circuit connected to one of input-output connectors of said dielectric duplexer, a receiving circuit connected to the other one of the input-output connectors of said dielectric duplexer, and an antenna connected to the antenna connector of said dielectric duplexer.

14. A dielectric resonator comprising:

a dielectric block having at least one surface;

an electrode disposed on said surface;

a metal casing surrounding said dielectric block;

a supporting portion protruding from one side of said metal casing toward the inside of said metal casing;

a conductive layer connecting said surface of the dielectric block with said supporting portion, edges of said conductive layer being spaced inwardly from edges of said one surface of said dielectric block; and an accessing element being disposed through an wall of said metal casing, said accessing element being electromagnetically coupled with said dielectric block.

* * * * *